US006758685B1

(12) United States Patent
Huang et al.

(10) Patent No.: US 6,758,685 B1
(45) Date of Patent: Jul. 6, 2004

(54) SERIAL ADVANCED TECHNOLOGY ATTACHMENT CONNECTOR

(75) Inventors: Ching-Bin Huang, Taipei (TW); Chih-Chuan Cheng, Taipei (TW); Wei-Pin Chuang, Taipei (TW)

(73) Assignee: Compal Electronics, Inc., Taipei (TW)

( * ) Notice: Subject to any disclaimer, the term of this patent is extended or adjusted under 35 U.S.C. 154(b) by 0 days.

(21) Appl. No.: 10/411,254

(22) Filed: Apr. 11, 2003

(51) Int. Cl.[7] ..... H01R 12/20
(52) U.S. Cl. ..... 439/79
(58) Field of Search ..... 439/79, 540.1, 439/660

(56) References Cited

U.S. PATENT DOCUMENTS 6,162,091 A * 12/2000 Kurotori et al. ..... 439/567
6,168,462 B1 * 1/2001 Liao ..... 439/541.5
6,203,335 B1 * 3/2001 Chang ..... 439/79
6,217,347 B1 * 4/2001 Schell et al. ..... 439/79
6,302,704 B1 * 10/2001 Belanger, Jr. ..... 439/67
6,322,377 B2 * 11/2001 Middlehurst et al. ..... 439/79
6,341,988 B1 * 1/2002 Zhu et al. ..... 439/630
6,638,079 B1 * 10/2003 Billman et al. ..... 439/76.1
6,638,104 B2 * 10/2003 Hashimoto et al. ..... 439/567
6,666,695 B1 * 12/2003 Yeh ..... 439/79
6,672,884 B1 * 1/2004 Toh et al. ..... 439/79
6,679,733 B2 * 1/2004 Crane et al. ..... 439/660
6,699,070 B1 * 3/2004 Wu ..... 439/574

* cited by examiner

*Primary Examiner*—Gary Paumen
(74) *Attorney, Agent, or Firm*—Bacon & Thomas, PLLC

(57) ABSTRACT

A SATA connector includes a housing, signal and power panels disposed in the housing, first and second signal terminals mounted on two opposite surfaces of the signal panel that are opposite to each other in a vertical direction, and first and second power terminals respectively mounted on two opposite surfaces of the power panel that are opposite to each other in the vertical direction. The power panel is aligned with the signal panel in a direction perpendicular to the vertical direction.

6 Claims, 3 Drawing Sheets

SERIAL ADVANCED TECHNOLOGY ATTACHMENT CONNECTOR

BACKGROUND OF THE INVENTION

1. Field of the invention

This invention relates to a serial advanced technology attachment (SATA) connector, more particularly to a serial advanced technology attachment connector that can be installed on a housing of a notebook computer for connecting an external hard drive to a mother board of the notebook computer.

2. Description of the related art

FIG. 1 illustrates a conventional serial advanced technology attachment (SATA) connector 1 that is installed on a mother board in a housing of a notebook computer (not shown) for electrically connecting an internal hard drive, such as a hard disc drive or a CD (compact disc) drive, through an assembly of a signal plug 12 and a power plug 14. The conventional SATA connector 1 includes a signal sub-connector 11 for mating with the signal plug 12, and a power sub-connector 13 for mating with the power plug 14. Since the hard disc drive in the housing of the notebook computer rotates at a very high speed during data transmission, a relatively large amount of heat is generated in the housing of the notebook computer, which can result in an increase in the temperature of the notebook computer, and which can have an adverse effect on the performance of the notebook computer. Moreover, since terminals on the signal sub-connector 11 and terminals on the power sub-connector 13 are aligned in a longitudinal direction, the conventional SATA connector 1 has a relatively long length in the longitudinal direction.

SUMMARY OF THE INVENTION

Therefore, the object of the present invention is to provide a SATA connector that is adapted to be installed on the housing of a notebook computer instead of being installed on the mother board as required by the prior art so as to permit electrical connection of the mother board to an external hard drive and that is relatively compact so as to reduce the length thereof as compared to that of the conventional SATA connector.

According to the present invention, there is provided a serial advanced technology attachment connector that comprises: an insulating housing defining a mounting space therein and having a bottom wall that defines a horizontal plane, and a front open end for access into the mounting space; an insulating signal panel disposed in the mounting space, parallel to the horizontal plane, and having opposite first and second surfaces that are parallel to the horizontal plane; an insulating power panel disposed in the mounting space, parallel to the horizontal plane, and aligned with the signal panel in a first direction that is parallel to the horizontal plane, the power panel having opposite first and second surfaces that are parallel to the horizontal plane; a plurality of first signal terminals, each of which has a contact extension and a leg, the contact extensions of the first signal terminals being laid on the first surface of the signal panel, being parallel to each other, extending in a second direction that is transverse to the first direction, and being aligned in the first direction, the leg extending from the contact extension in a vertical direction through the bottom wall, the vertical direction being perpendicular to the horizontal plane; a plurality of second signal terminals, each of which has a contact extension and a leg, the contact extensions of the second signal terminals being laid on the second surface of the signal panel, being parallel to each other, extending in the second direction, and being aligned in the first direction, the leg extending from the contact extension of the second signal terminal in the vertical direction through the bottom wall; a plurality of first power terminals, each of which has a contact extension and a leg, the contact extensions of the first power terminals being laid on the first surface of the power panel, being parallel to each other, extending in the second direction, and being aligned in the first direction, the leg of each of the first power terminals extending from the contact extension of the first power terminal in the vertical direction through the bottom wall; and a plurality of second power terminals, each of which has a contact extension and a leg. The contact extensions of the second power terminals are laid on the second surface of the power panel, are parallel to each other, extend in the second direction, and are aligned in the first direction. The leg of each of the second power terminals extends from the contact extension of the second power terminal in the vertical direction through the bottom wall.

BRIEF DESCRIPTION OF THE DRAWINGS

In drawings which illustrate an embodiment of the invention.

DETAILED DESCRIPTION OF THE PREFERRED EMBODIMENT

Figure 1:
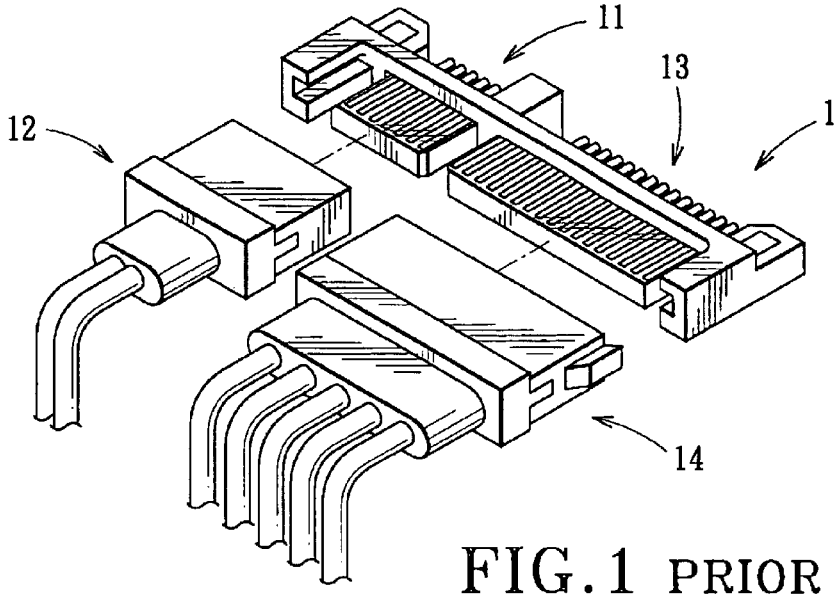
FIG. 1 PRIOR ART
FIG. 1 is a perspective view of a conventional serial advanced technology attachment (SATA) connector, which can be electrically connected to a hard drive through an assembly of a power plug and a signal plug.
Figure 2:
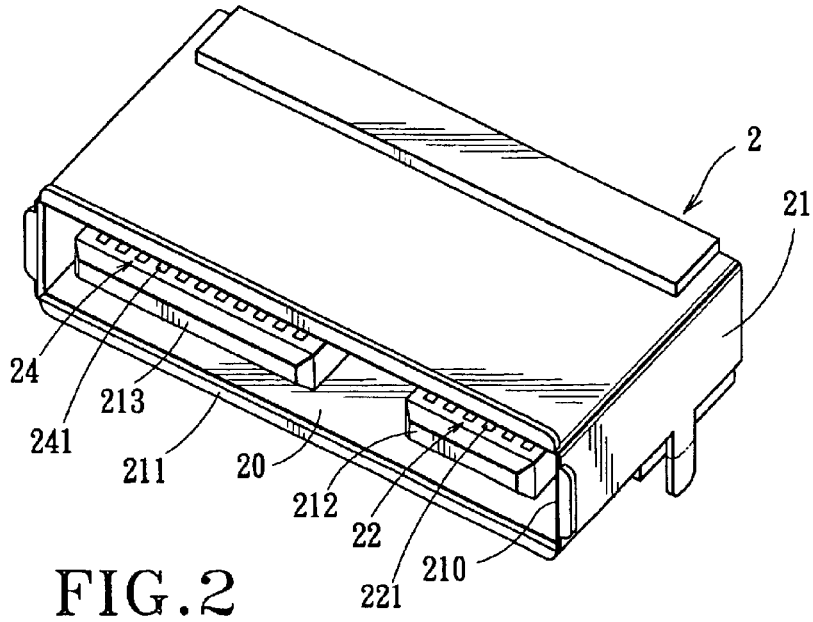
FIG. 2 is a perspective view of a SATA connector embodying this invention.
Figure 3:
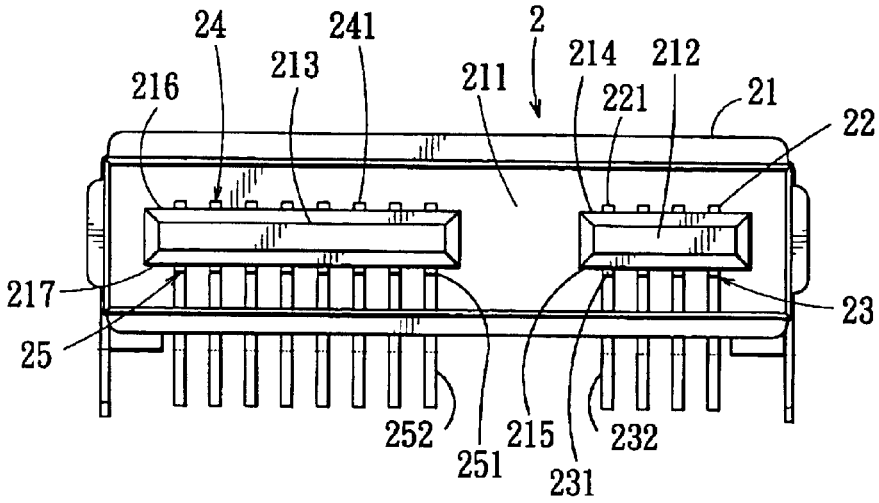
FIG. 3 is a front view of the SATA connector of FIG. 2.
Figure 4:
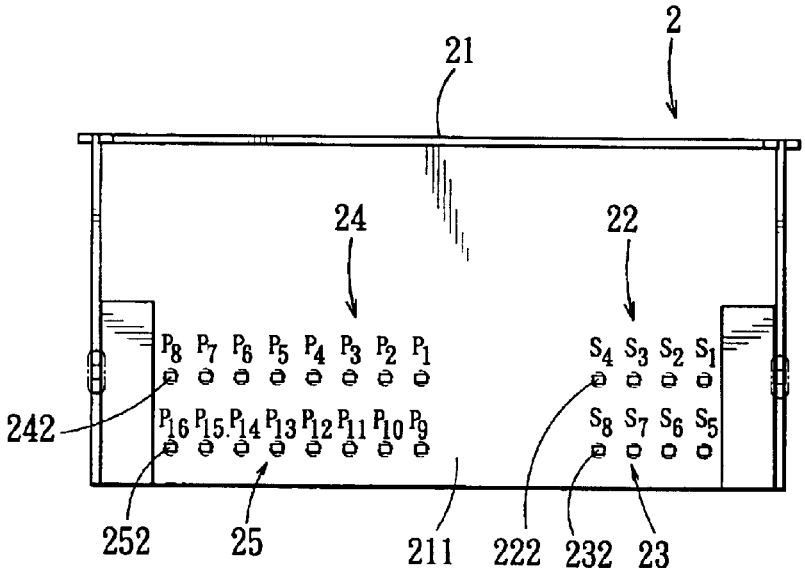
FIG. 4 is a fragmentary bottom view of the SATA connector of FIG. 2.

FIGS. 2 to 4 illustrate a serial advanced technology attachment (SATA) connector 2 embodying this invention. The SATA connector 2 is to be installed on a housing of a notebook computer (not shown) instead of being installed on a mother board of the notebook computer as required by the prior art so as to permit electrical connection of the mother board to an external hard drive (not shown). The SATA connector 2 includes: an insulating housing 21 defining a mounting space 20 therein and having a bottom wall 211 that defines a horizontal plane, and a front open end 210 for access into the mounting space 20; an insulating signal panel 212 disposed in the mounting space 20, parallel to the horizontal plane, and having opposite first and second surfaces 214, 215 that are parallel to the horizontal plane; an insulating power panel 213 disposed in the mounting space 20, parallel to the horizontal plane, and aligned with the signal panel 212 in a first direction that is parallel to the horizontal plane, the power panel 213 having opposite first and second surfaces 216, 217 that are parallel to the horizontal plane; a plurality of first signal terminals 22, each of which has a contact extension 221 and a leg 222, the contact extensions 221 of the first signal terminals 22 being laid on the first surface 214 of the signal panel 212, being parallel to each other, extending in a second direction that is transverse to the first direction, and being aligned in the first direction, the leg 222 extending from the contact extension 221 in a vertical direction through the bottom wall 211, the vertical direction being perpendicular to the horizontal plane; a plurality of second signal terminals 23, each of which has a contact extension 231 and a leg 232, the contact extensions 231 of the second signal terminals 23 being laid on the second surface 215 of the signal panel 212, being parallel to each other, extending in the second direction, and being aligned in the first direction, the leg 232 extending from the contact extension 231 of the second signal terminal 23 in the vertical direction through the bottom wall 211; a plurality of first power terminals 24, each of which has a contact extension 241 and a leg 242, the contact extensions 241 of the first power terminals 24 being laid on the first surface 216 of the power panel 213, being parallel to each other, extending in the second direction, and being aligned in the first direction, the leg 242 of each of the first power terminals 24 extending from the contact extension 241 of the first power terminal 24 in the vertical direction through the bottom wall 211; and a plurality of second power terminals 25, each of which has a contact extension 251 and a leg 252. The contact extensions 251 of the second power terminals 25 are laid on the second surface 217 of the power panel 213, are parallel to each other, extend in the second direction, and are aligned in the first direction. The leg 252 of each of the second power terminals 25 extends from the contact extension 251 of the second power terminal in the vertical direction through the bottom wall 211. The legs 222, 232, 242, 252 of the first and second signal terminals 22, 23 and the first and second power terminals 24, 25 are secured to the bottom wall 211 so as to suspend the signal and power panels 212, 213 in the housing 21, and are adapted to be electrically connected to the mother board (not shown).

In this preferred embodiment, the first and second signal terminals 22, 23 are equal in number (each group has 4 terminals), and the first and second power terminals 24, 25 are equal in number (each group has 8 terminals). The contact extension 221 of each of the first signal terminals 22 is aligned with the contact extension 231 of a respective one of the second signal terminals 23 in the vertical direction. The contact extension 241 of each of the first power terminals 24 is aligned with the contact extension 251 of a respective one of the second power terminals in the vertical direction. The leg 222 of each of the first signal terminals 22 is aligned with the leg 232 of the respective one of the second signal terminals 23 in the second direction. The leg 242 of each of the first power terminals 24 is aligned with the leg 252 of the respective one of the second power terminals 25 in the second direction. The thus formed SATA connector 2 is relatively compact, and has a reduced length in the first direction as compared to that of the conventional SATA connector.

The first signal terminals 22 include a first ground terminal (S1), a pair of first differential signal terminals (S2, S3), and a second ground terminal (S4), which are arranged in the first direction in the above order. The second signal terminals 23 include a third ground terminal (S5), a pair of second differential signal terminals (S6, S7), and a fourth ground terminal (S8), which are arranged in the first direction in the above order.

The first power terminals 24 include a first 3-volt power terminal (P1), a second 3-volt power terminal (P2), a third 3-volt power terminal (P3), a first ground terminal (P4), a second ground terminal (P5), a third ground terminal (P6), a first 12-volt power terminal (P7), and a second 12-volt power terminal (P8), which are arranged in the first direction in the above order.

The second power terminals 25 include a first 5-volt power terminal (P9), a second 5-volt power terminal (P10), a third 5-volt power terminal (P11), a fourth ground terminal (P12), a fifth ground terminal (P13), a sixth ground terminal (P14), a reserved terminal (P15), and a third 12-volt power terminal (P16), which are arranged in the first direction in the above order.

Figure 5:
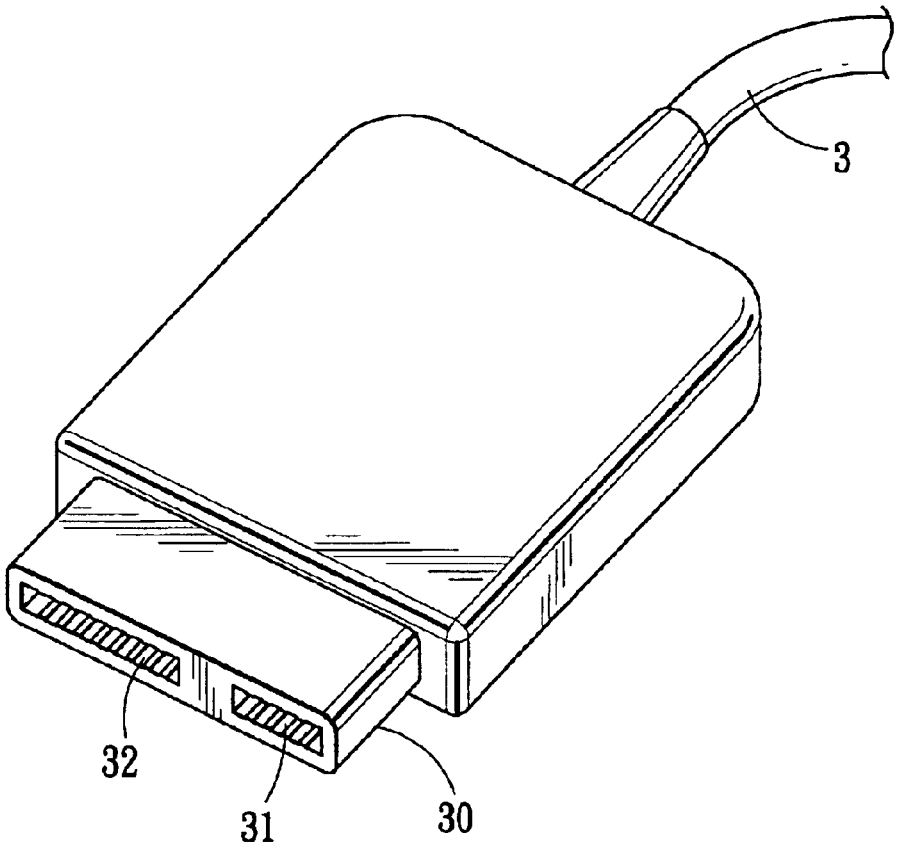
FIG. 5 is a perspective view of a plug for electrically connecting the SATA connector of FIG. 2 to a hard drive.

FIG. 5 illustrates a cable 3 with a plug 30 that is adapted to be electrically connected to the external hard drive (not shown) and that is formed with first and second terminal-receiving slots 31, 32 which respectively receive the signal panel 212 and the power panel 213 therein when the plug 30 is inserted into the mounting space 20 in the housing 21 of the SATA connector 2.

With the invention thus explained, it is apparent that various modifications and variations can be made without departing from the spirit of the present invention. It is therefore intended that the invention be limited only as recited in the appended claims.

We claim:

1. A serial advanced technology attachment connector comprising:

an insulating housing defining a mounting space therein and having a bottom wall that defines a horizontal plane, and a front open end for access into said mounting space;

an insulating signal panel disposed in said mounting space, parallel to said horizontal plane, and having opposite first and second surfaces that are parallel to said horizontal plane;

an insulating power panel disposed in said mounting space, parallel to said horizontal plane, and aligned with said signal panel in a first direction that is parallel to said horizontal plane, said power panel having opposite first and second surfaces that are parallel to said horizontal plane;

a plurality of first signal terminals, each of which has a contact extension and a leg, said contact extensions of said first signal terminals being laid on said first surface of said signal panel, being parallel to each other, extending in a second direction that is transverse to said first direction, and being aligned in said first direction, said leg extending from said contact extension in a vertical direction through said bottom wall, said vertical direction being perpendicular to said horizontal plane;

a plurality of second signal terminals, each of which has a contact extension and a leg, said contact extensions of said second signal terminals being laid on said second surface of said signal panel, being parallel to each other, extending in said second direction, and being aligned in said first direction, said leg extending from said contact extension of said second signal terminal in said vertical direction through said bottom wall;

a plurality of first power terminals, each of which has a contact extension and a leg, said contact extensions of said first power terminals being laid on said first surface of said power panel, being parallel to each other, extending in said second direction, and being aligned in said first direction, said leg of each of said first power terminals extending from said contact extension of said first power terminal in said vertical direction through said bottom wall; and a plurality of second power terminals, each of which has a contact extension and a leg, said contact extensions of said second power terminals being laid on said second surface of said power panel, being parallel to each other, extending in said second direction, and being aligned in said first direction, said leg of each of said second power terminals extending from said contact extension of said second power terminal in said vertical direction through said bottom wall.

2. The connector of claim 1, wherein said first and second signal terminals are equal in number, and said first and second power terminals are equal in number, said contact extension of each of said first signal terminals being aligned with said contact extension of a respective one of said second signal terminals in said vertical direction, said contact extension of each of said first power terminals being aligned with said contact extension of a respective one of said second power terminals in said vertical direction, said leg of each of said first signal terminals being aligned with said leg of the respective one of said second signal terminals in said second direction, said leg of each of said first power terminals being aligned with said leg of the respective one of said second power terminals in said second direction.

3. The connector of claim 1, wherein said first signal terminals include a first ground terminal, a pair of first differential signal terminals, and a second ground terminal.

4. The connector of claim 3, wherein said second signal terminals include a third ground terminal, a pair of second differential signal terminals, and a fourth ground terminal.

5. The connector of claim 4, wherein said first power terminals include a first 3-volt power terminal, a second 3-volt power terminal, a third 3-volt power terminal, a first ground terminal, a second ground terminal, a third ground terminal, a first 12-volt power terminal, and a second 12-volt power terminal.

6. The connector of claim 5, wherein said second power terminals include a first 5-volt power terminal, a second 5-volt power terminal, a third 5-volt power terminal, a fourth ground terminal, a fifth ground terminal, a sixth ground terminal, a reserved terminal, and a third 12-volt power terminal.

* * * * *